US008167672B2

(12) United States Patent
Starmer

(10) Patent No.: US 8,167,672 B2
(45) Date of Patent: May 1, 2012

(54) BUOYANT CUSHION

(76) Inventor: Laura Starmer, St. Johns, FL (US)

( * ) Notice: Subject to any disclaimer, the term of this patent is extended or adjusted under 35 U.S.C. 154(b) by 0 days.

(21) Appl. No.: 12/915,970

(22) Filed: Oct. 29, 2010

(65) Prior Publication Data

US 2011/0070788 A1 Mar. 24, 2011

(51) Int. Cl.
*B63C 9/30* (2006.01)

(52) U.S. Cl. ..... 441/129

(58) Field of Classification Search ..... 441/125–130
See application file for complete search history.

(56) References Cited

U.S. PATENT DOCUMENTS 4,011,611 A * 3/1977 Lederman ..... 5/655.4
4,689,844 A * 9/1987 Alivizatos ..... 5/702
4,822,309 A * 4/1989 Vandenberg ..... 441/35

OTHER PUBLICATIONS http://web.archive.org/web/20030228110453/http://www.ah_hprods.com/refill Feb. 28, 2003.*

* cited by examiner

*Primary Examiner* — Edwin Swinehart
(74) *Attorney, Agent, or Firm* — Arthur G. Yeager

(57) ABSTRACT

Buoyant cushions or the like are used and are adaptable for varied other uses, such cushions having physical properties that include buoyancy, weather-resistance, malleability, strength, and comfort to the user, and allows the cushion to be used dually as lounging floatations in bodies of water and as cushions adapted to compliment outdoor furniture or used as furniture. The chamber of each cushion is partially filled with polystyrene beads and the outer surface is defined primarily by a comfortable flexible fabric material to support a user and a flexible mesh fabric material to permit ingress and egress of water to the chamber, such materials being sewn together to form the cushion.

16 Claims, 8 Drawing Sheets

BUOYANT CUSHION

CROSS-REFERENCE TO RELATED APPLICATION

This application claims priority from U.S. application Ser. No. 12/563,851, filed Sep. 21, 2009 now abandoned.

STATEMENT REGARDING FEDERALLY SPONSORED RESEARCH OR DEVELOPMENT

Not Applicable.

BACKGROUND OF THE INVENTION

1. Field of the Invention

The present invention relates generally to buoyant cushions for use in water, such as a lake or a pool and being adaptable for use as outdoor furniture or in cooperation with outdoor furniture.

2. Description of the Related Art

Conventional floatation devices for use in water at a swimming pool, a river, a lake or the like are typically inflatable. These inflatable floatation devices, although fully capable of supporting the weight of a person, suffer from numerous shortcomings. A user of these conventional floatation devices is essentially required to inflate the device before each use. Conventional floatation devices having insufficient air pressure often results in the device sinking or suspending the user underwater. In order to inflate these floatation devices the user is required to inflate same by lung power or to bring an air pump to the desired location. Furthermore, these conventional floatation devices are typically being manufactured from thin plastic materials that are prone to scratches and punctures that consequently render them useless as a floatation device. Resultingly, these conventional floatation devices can only be used in the pool and cannot be used as outdoor furniture or in conjunction with outdoor furniture.

BRIEF SUMMARY OF THE INVENTION

The present invention relates generally to a buoyant cushion for use in a pool or the like and being adaptable for use as outdoor furniture or in cooperation with outdoor furniture. The buoyant cushion having physical properties that include buoyancy, weather-resistance, and malleability that allow the buoyant cushion to be used dually as a lounging floatation device, in bodies of water such as pools, lakes, or the ocean, and as a cushion adapted to complement outdoor furniture or to be used independently as, for example, a mattress.

The buoyant cushion includes a mechanically compliant exterior casing or covering that defines a mechanically compliant chamber therewithin. The chamber contains a plurality of buoyant beads that enable the buoyant cushion to support the weight of a user or an object in a body of liquid to the extent that at least a portion of the user or object is maintained above the surface of the water. Additionally, because of the properties of the buoyant cushion the cushion is adapted to serve as a weatherproof cushion that complements a piece of outdoor furniture or to serve as an independent furniture-type device or piece when the buoyant cushion is not being used as a floatation device.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

The present invention relates generally to a buoyant cushion for use in water and being adaptable for use as outdoor furniture or in cooperation with outdoor furniture or by itself as furniture. More specifically, the buoyant beads enable the buoyant cushion to support the weight of a user or object in a body of water to the extent that at least a portion of the user is maintained above the surface of the water. Additionally, the buoyant cushion is adapted to serve as a weatherproof cushion that complements a piece of outdoor furniture or to serve as furniture. One embodiment of the buoyant cushion constructed in accordance with the various features of the present invention is illustrated generally at 10 in FIG. 1.

Figure 1:
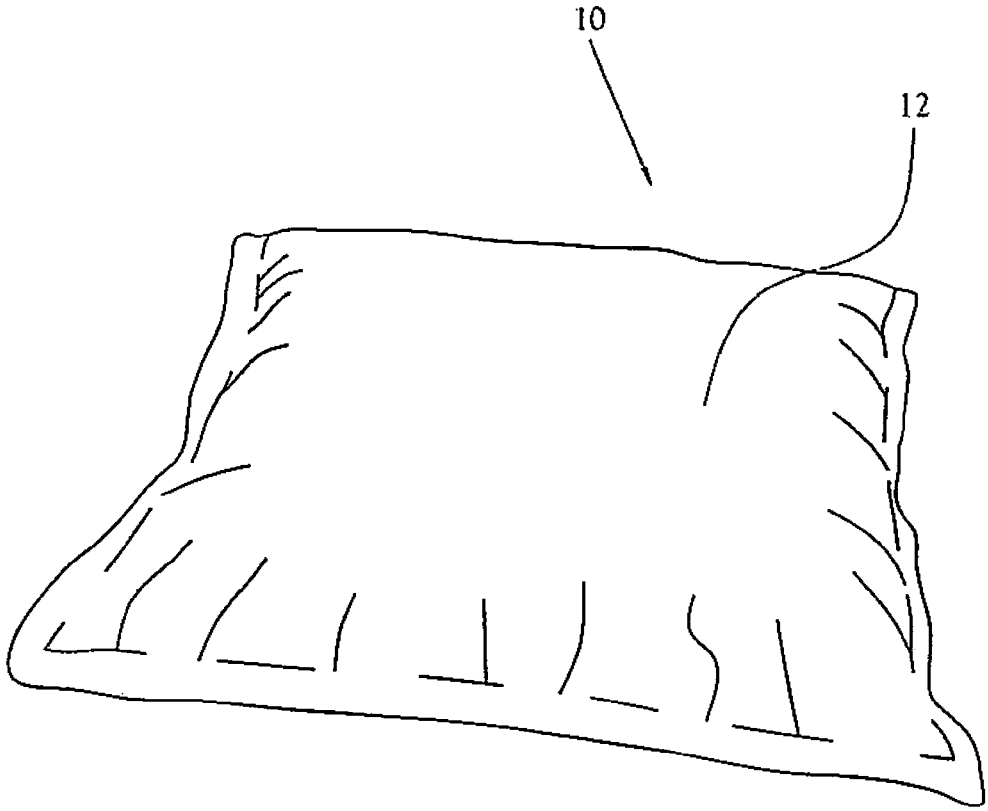
FIG. 1 illustrates one embodiment of the buoyant cushion in accordance with the various features of the present invention.

FIG. 1 depicts one embodiment of the buoyant cushion 10 having a substantially rectangular contour. The buoyant cushion 10 includes a mechanically compliant exterior covering 12 and defines a mechanically compliant chamber therewithin. In accordance with one embodiment, the buoyant cushion 10 includes an internal covering and an external covering. More specifically, the internal covering defines a mechanically compliant chamber while the exterior covering provides protection to the internal covering. The internal covering and external covering may be permanently joined together or releasably connectable such that the exterior covering may be replaced. The exterior covering 12 is constructed of a compliant or strong flexible material that is water repellant and otherwise weather-resistant. For example, in one embodiment, the exterior covering 12 is constructed of an acrylic fabric, rendering the exterior covering 12 not only weather-resistant, but also UV-resistant and mildew-resistant. One example of such an acrylic fabric is the Sunbrella® fabrics manufactured by Glen Raven Mills, Inc. Additionally, the buoyant cushion 10 may be contoured and dimensioned to function as a seating cushion, small neck-supporting pillow, throw pillow, or roll-type pillow to be used, for example, at poolside.

Figure 2:
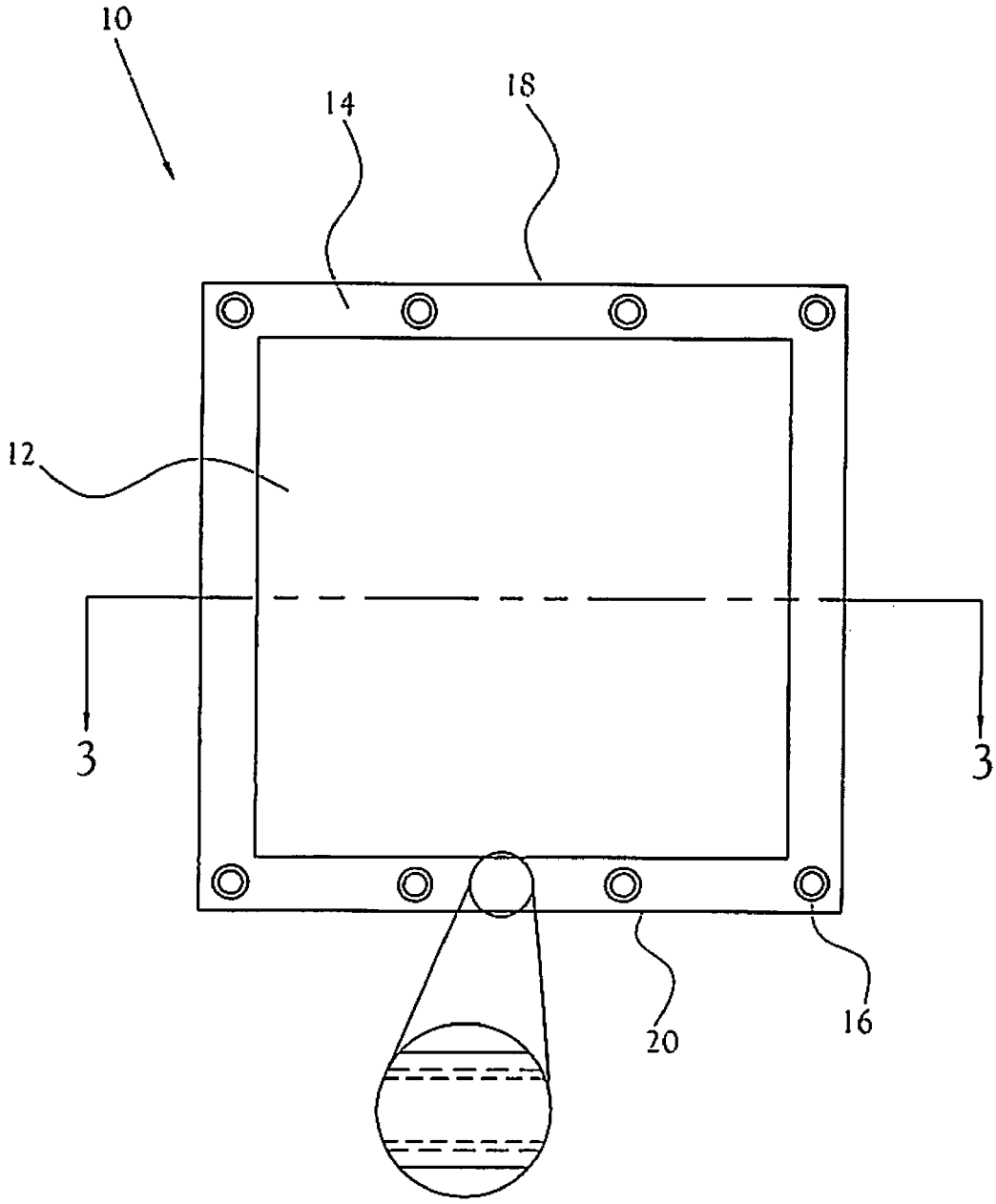
FIG. 2 illustrates an alternate embodiment of the buoyant cushion having a plurality of grommets at opposing ends of the buoyant cushion.

FIG. 2 illustrates another embodiment of the buoyant cushion 10 that has a rim 14 about the perimeter of the chamber. In the illustrated embodiment, the rim 14 includes a reinforced seam defined by the exterior covering 12. The rim 14 may extend from the exterior covering 12 by two inches and have additional seams to reinforce the rim 14 and inhibit bursting and the escape of the beads 24, hereinafter set forth. The rim 14 provides a user with a handle for maneuvering and/or transporting the buoyant cushion 10 in and around a body of water.

Furthermore FIG. 2 depicts at least one grommet 16 through the rim 14. The grommet 16 may be defined by reinforced stitching so as not to include an additional eyelet made of, for example, metal, plastic, or rubber. The buoyant cushion 10 may include a first grommet and a second grommet which enables a user to tether the buoyant cushion 10 to a stationary object, such as a dock, and to fold and bind the buoyant cushion 10, for example using a fastener, for compact transportation.

In another embodiment, the grommets 16 may allow the buoyant cushion 10 to function as a hammock. More specifically, this embodiment of the buoyant cushion 10 has a contour that is substantially that of a hammock such that the buoyant cushion 10 includes a first end 18 and a second end 20, the first end 18 being opposite the second end 20 with respect to the buoyant cushion 10. Additionally, in the illustrated embodiment, the buoyant cushion 10 includes a plurality of grommets 16 at the first end 18 and a plurality of grommets 16 at the second end 20. The grommets 16 are adapted to receive suspension devices, such as ropes, such that when the suspension devices are secured to a structural support(s), such as a pair of spaced trees or hammock stand, the buoyant cushion 10 is suspended in the same manner as would be a conventional hammock. The cushion 10 may be suspended from a single tree limb and the user may sit thereon and swing, if desired.

Figure 3:
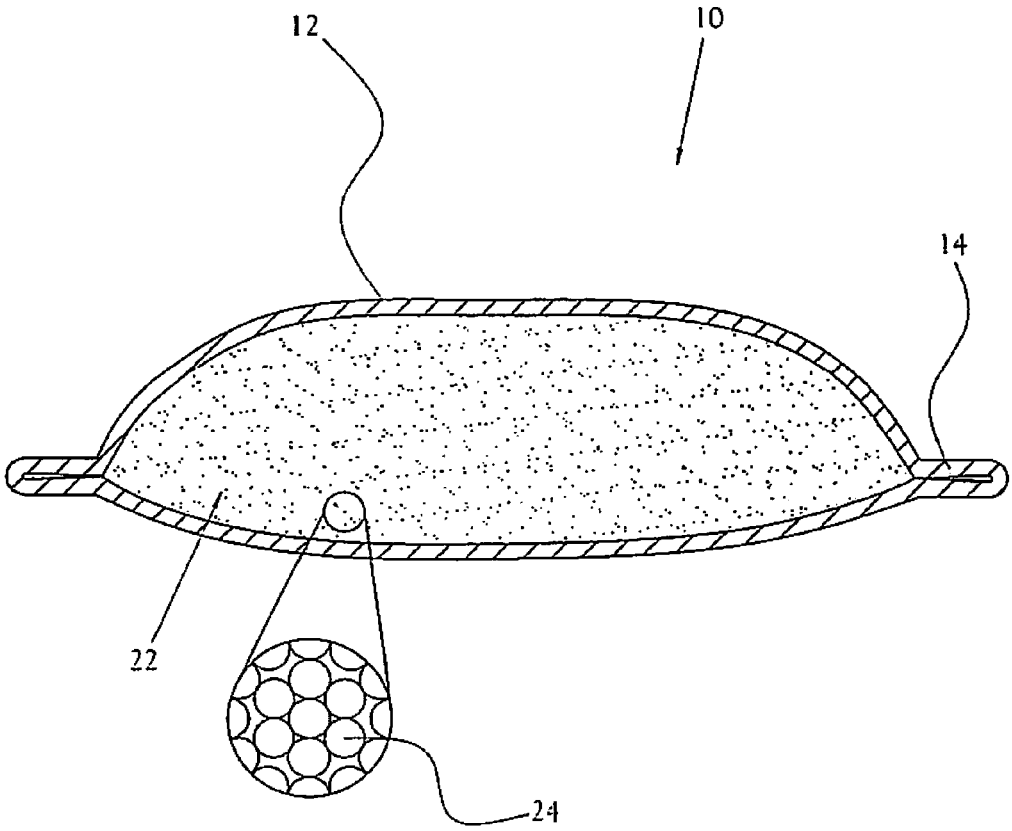
FIG. 3 illustrates a sectional view of the buoyant cushion of FIG. 2 taken along lines 3-3.

FIG. 3 illustrates a chamber 22 defined by the buoyant cushion 10 housing a plurality of buoyant beads 24. The buoyant beads 24 partially fill the chamber and provide the buoyant cushion 10 with its buoyancy, enabling the buoyant cushion 10 to support a user, such as a human, in a body of water to the extent that at least a portion of the human is maintained above the surface of the water, as discussed above. In one embodiment, the buoyant beads 24 are constructed of a virgin polystyrene material. The virgin polystyrene beads do not absorb water or resins and do not expand to the extent that the beads crack or separate. As a result, the beads are not prone to collect moisture or debris, which reduces the probability of mold or mildew developing in or on the beads. The buoyant beads are small in size, such as having a 3 mm diameter, such that the buoyant cushion 10 is substantially conformable and malleable. Because the buoyant beads 24 provide the buoyant cushion 10 with its buoyancy, the buoyant cushion 10 cannot be deflated, such as by way of a puncture to the exterior covering 12. Even a hole through the covering, if less than about 3 mm in diameter will not permit escape of the beads 24 from the chamber of cushion 10.

Figure 4:
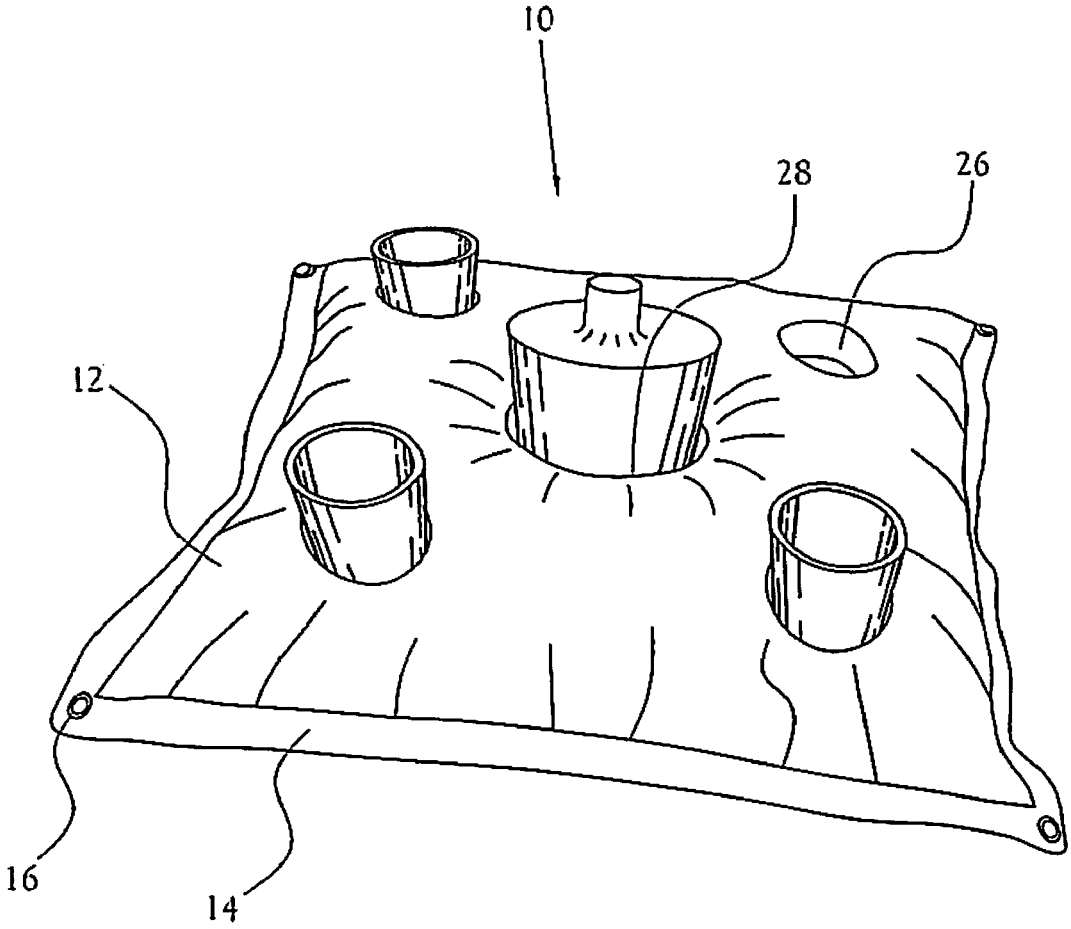
FIG. 4 illustrates another embodiment of the buoyant cushion defining a cup holder and a cooler.

FIG. 4 depicts cushion 10 in a different form so that the outer covering 12 defines at least one cup holder 26 and a cubby 28 for holding a small cooler or even personal items, such as a wallet or keys. The chamber of cushion 12 defines the cup holder 26 and the cubby 28 by defining a recess that extends within the chamber. As a result, the buoyant beads substantially surround the recess such that the buoyant beads provide thermal insulation for the cup holders 26 and the cubby 28. The cup holders 26 and the cubby 28 may extend past the chamber thereby allowing the cups to obtain some cooling or thermal insulation from the water below the buoyant cushion 10. In another embodiment of the present invention, the outer covering 12 and the chamber define a cooler having a lid.

Figure 5:
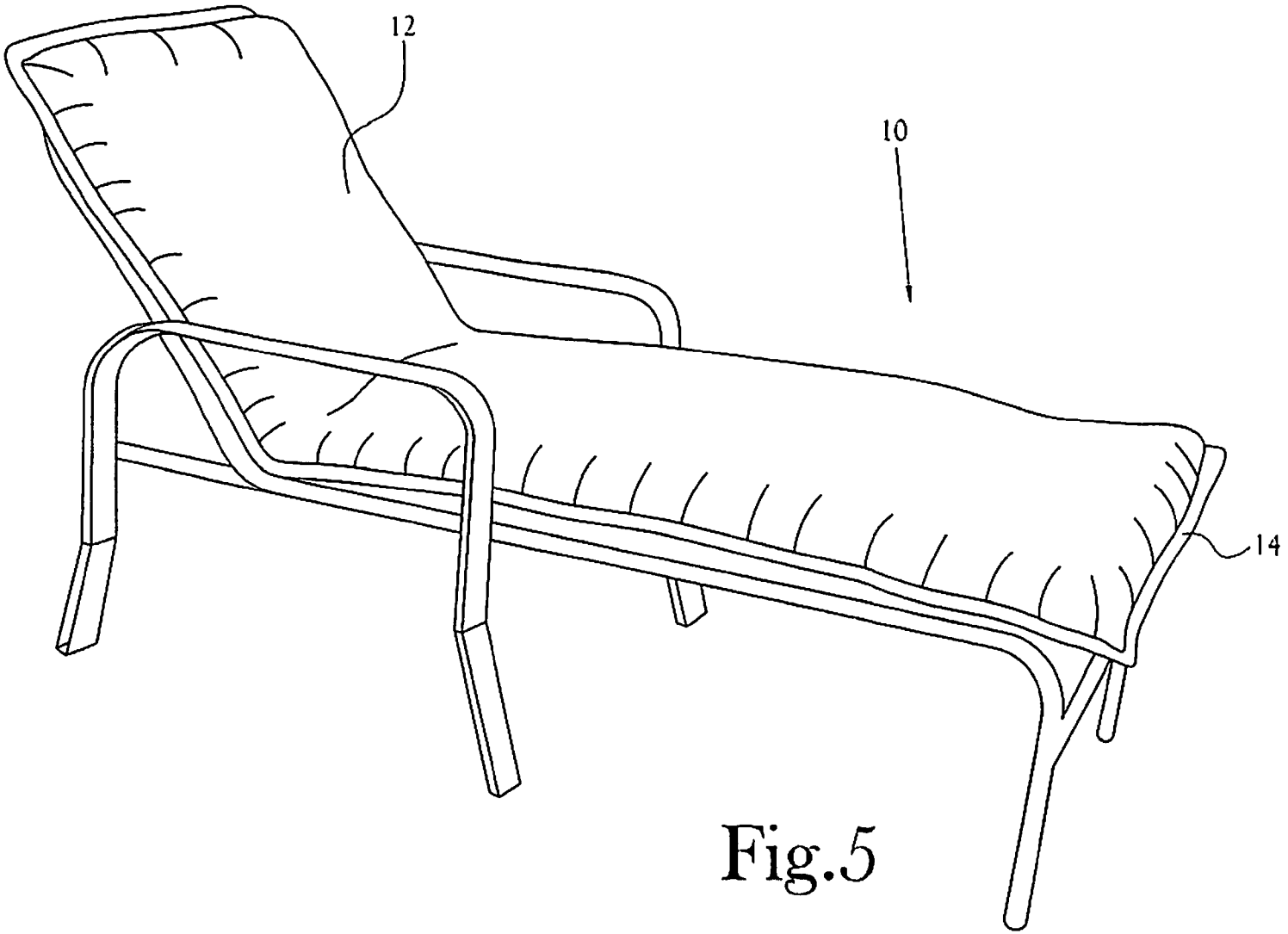
FIG. 5 illustrates an elongated embodiment of FIG. 1 with the buoyant cushion cooperating with a lounge chair.

FIG. 5 illustrates the buoyant cushion 10 contoured and dimensioned as a lounge pillow to cooperate with conventional poolside outdoor furniture. Because the buoyant cushion 10 is malleable and weather-resistant, it is capable of cooperating with and withstanding the environmental exposure associated with outdoor furniture. The outer covering 12 is amendable such that the buoyant cushion 10 conforms to the lounge chair, namely a rectangular portion of the lounge chair where a user sits and/or reclines thereon. In alternate embodiments of the present invention, the buoyant cushion 10 may be easily contoured and dimensioned to cooperate with a platform bed, an outdoor bed having table tops and a storage compartment, a standard chair, a hanging chair frame, a porch swing, and a bench seat cabana, or to be used by itself on the ground, poolside and/or an extra mattress.

Figure 6:
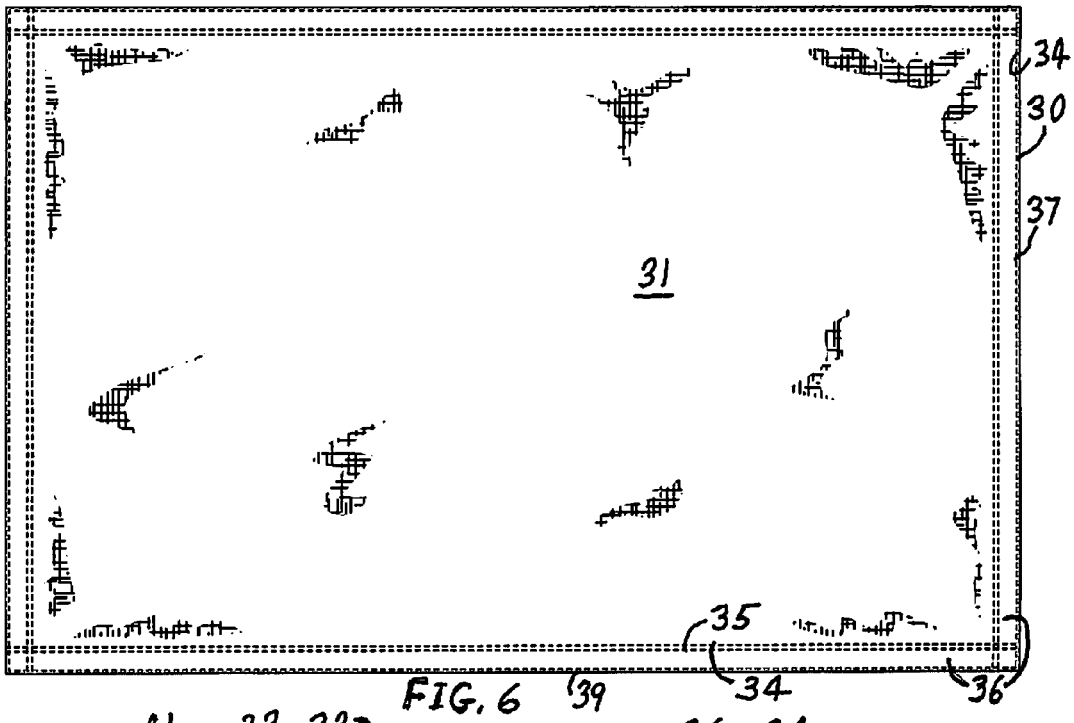
FIG. 6 is a top plan view of a further embodiment of the buoyant cushion according to the present invention.
Figure 7:
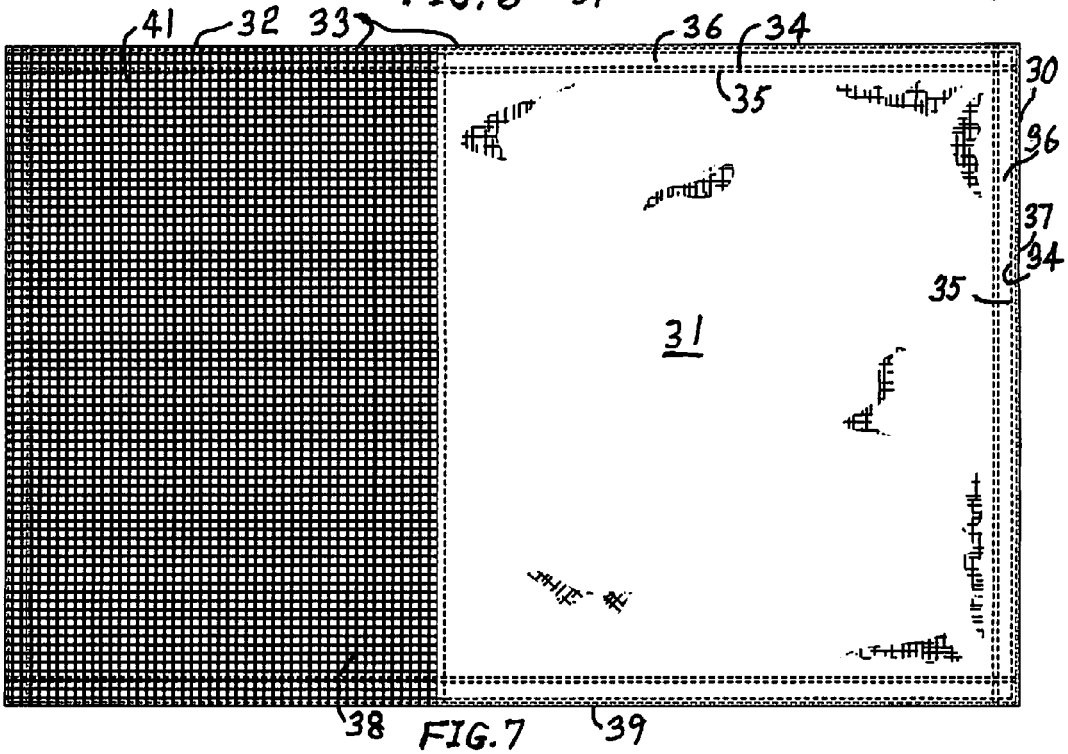
FIG. 7 is a bottom plan view of FIG. 6.

FIGS. 6 and 7 depict a further embodiment of the invention, the buoyant cushion 30 is rectangular in form and includes a substantially weather-resistant flexible fabric material 31 that is comfortable for a human user to lay or sit on yet strong as durable for use in a number of different ways and environments, water, poolside— with or without furniture, etc. Sewn to fabric material 31 is another substantially weather-resistant flexible mesh fabric material 32, which may extend partially to form a bottom 33 with fabric material 31, as shown in FIG. 7, or may extend the full length and width of the bottom 33. The mesh fabric material 32 is somewhat more rigid than the fabric material 31 and is not as comfortable to support a human user. The stitching lines 34, 35 are made to provide a rim 36 around the cushion 30 which includes a casing 37 defining an internal chamber 38 and formed by an exterior covering 39. Additionally, double stitching lines 34, 35 are provided along the edges of cushion 30, lines 34 and 35 being shown in FIG. 7, but line 34 only being shown in FIG. 7, since line 35 is an initial stitch through the wrong side of the fabric, as known to persons skilled in the sewing arts.

Figure 8:
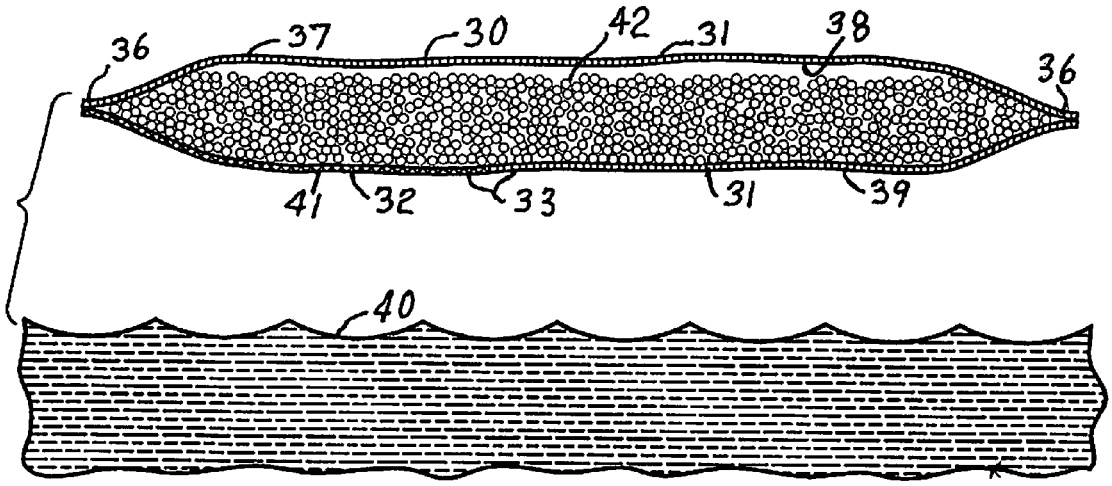
FIG. 8 is a horizontal sectional medial view of FIG. 6, with the cushion above the water.
Figure 9:
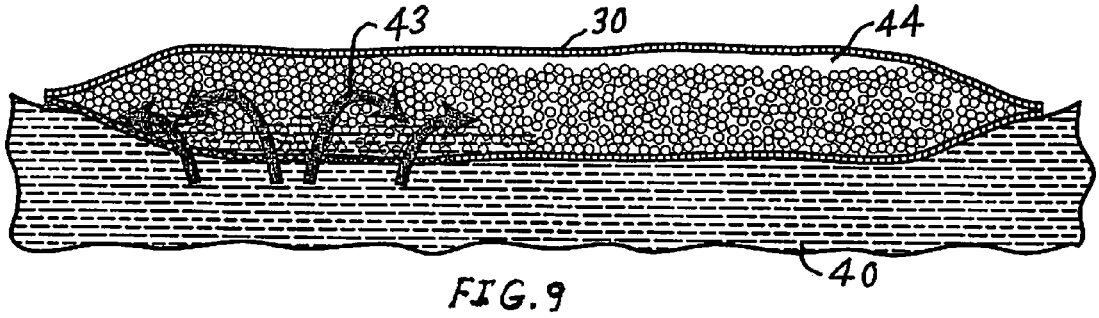
FIG. 9 is a view similar to FIG. 8 and depicting the cushion partially immersed in water with water entering into the chamber of the cushion.
Figure 10:
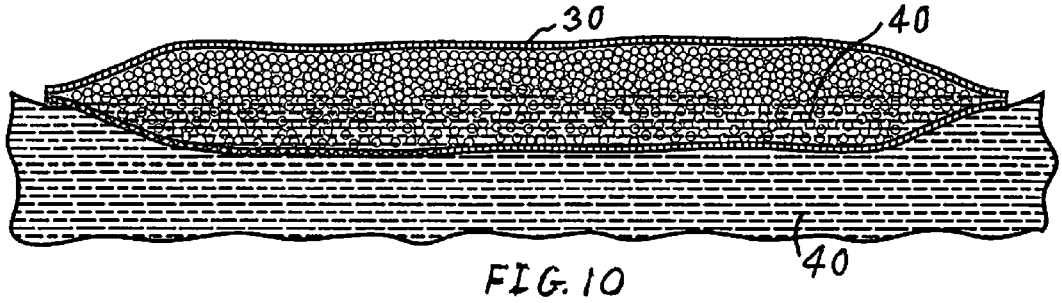
FIG. 10 is a view similar to FIG. 8 depicting the cushion with the beads and water filling the chamber of the cushion.
Figure 11:
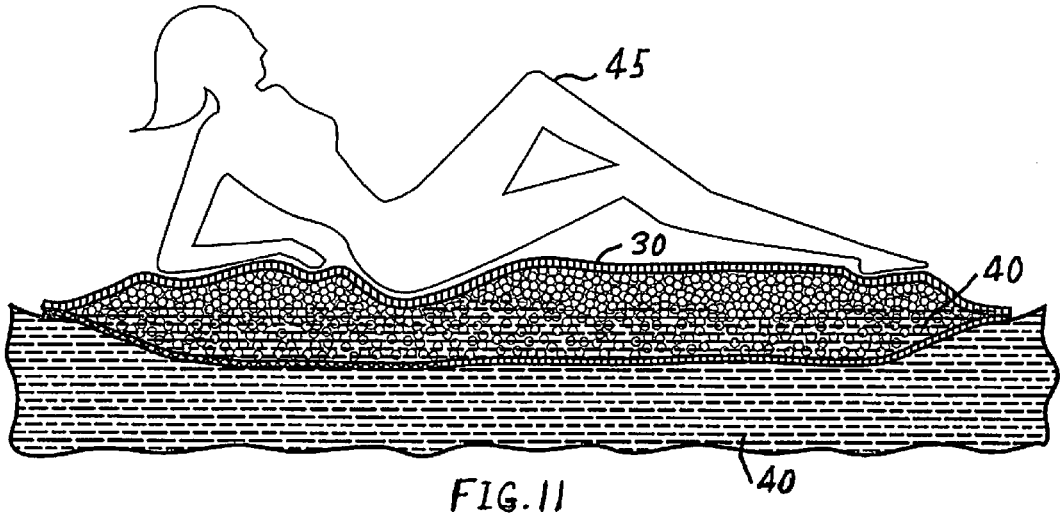
FIG. 11 is a view similar to FIG. 10 with an object or a user buoyantly supported on the cushion.

The cushion 30 is depicted in FIG. 8 above water 40 prior to placement thereinto. The mesh fabric material 32 has predetermined size openings 41 therethrough to permit the ingress and egress of water 40 therethrough but smaller in size to prevent passage of the buoyant expanded beads 42 therethrough. The mesh openings 41 of fabric 32 substantially retain their predetermined size and shape and the cross-threads may or may not be woven, but are glued and/or fused together to maintain such size and shape. The beads 42 are seen to only partially fill chamber 38, so that when immersed in water as shown in FIG. 9, water 40 will begin flowing through mesh openings 41 illustrated by arrows 43. While FIG. 10 depicts the cushion 30 with water 40 generally replacing the air space 44, likely some air does escape out of the stitching lines 34, 35, air remains entrained between and among the beads 42. In FIG. 11, a human user 45 is shown supported on cushion 30, with the cushion 30 being deformed by the weight of the user in contact with cushion 30. With the cushion 30 in water 40 and a user 45 supported thereon, the stability of the cushion 30 is enhanced, as well as the comfort of the user 45 an effect of being supported by a water bed, since water 40 is also with the beads 42 within chamber 38.

In FIG. 4 embodiment of cushion 10, the buoyant beads 24 are depicted as substantially filling the chamber of cushion 10 to enable the cup holder 26 and cubby 28 to retain the shapes intended for the cushion 10. However, in the FIGS. 6-11 cushion 30 embodiment, where the beads 42 only partially fill the chamber 38, the bead fill volume should be between 65% to 80% of the total fillable volume of the cushion 30 to provide the appropriate feel and comfort to the human user 45, as well as providing the desired buoyancy. Too much bead fill renders the large float cushions too stiff and uncomfortable and too little bead fill renders them too soggy and insufficient buoyancy. Accordingly, the preferred range is 70% to 75% to provide optimum results.

The weather-resistant, UV-resistant and mildew-resistant fabric material 31 may be an acrylic fabric, such as Sunbrella® fabrics manufactured by Glen Raven Mills, Inc. The mesh fabric material 32 preferably has similar qualities being weather-resistant, UV-resistant and mildew-resistant and may be a polyester woven mesh coated polyester fabric such as Bondcote's TufMesh Plus® fabric, or Glen Raven's Textilene® fabrics, or Phifer Wire's Phifertex® fabrics, or other appropriate fabric material. The mesh fabric material 32 may be polyvinylchloride coated to not only enhance its physical properties, but to assist in maintaining and stabilizing the woven mesh in its intended openness factor of approximately 35%, i.e., so the square or rectangular openings retain their shape of less than 3 mm bead size in any direction. Even the thread employed to make the seams of the buoyant cushion 10 and the cushion 30, likewise should have similar qualities, weather-resistant, UV-resistant and mildew-resistant and may be a bonded, twisted, continuous-filament polyester thread such as Coats' Dabond®, heavy, recommended for canvas, tarps, etc. Not only the above qualities, but also for its strength, sewability and lasting characteristics. The thread also is bonded to resist against ply untwisting, even in zigzag sewing and other features set forth by Coats®, a well-known leader in thread technology.

While the present invention has been illustrated by description of several embodiments and while the illustrative embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the general inventive concepts.

What is claimed is:

1. A buoyant cushion comprising:

a casing defining a chamber there within, said casing being formed by an exterior covering of a substantially weather-resistant flexible fabric material, and a materially different substantially weather-resistant flexible mesh fabric material sewn together to form said casing, said casing having an upper surface and a lower surface, said flexible fabric material being resistant to water flow there through and comfortable for a human user thereof, said flexible fabric material forming said upper surface of said casings, said mesh fabric material being more rigid than said flexible fabric material and forming at least a portion of said lower surface and having predetermined size openings there through, a plurality of buoyant expanded plastic beads having a size greater than said predetermined size openings and disposed within said chamber and partially filling said chamber, said buoyant beads providing said cushion with sufficient buoyancy to support an user thereon in a body of water to maintain such object at least partially above water, and said mesh fabric material permitting water to flow through said predetermined size openings into said chamber during use of said cushion in water to enhance comfort of the user on said upper surface and the stability of said cushion in water, and to permit drainage therefrom when said cushion is removed from the water.

2. The buoyant cushion of claim 1 wherein said plurality of buoyant beads are of virgin polystyrene material.

3. The buoyant cushion of claim 1 wherein said buoyant beads have a dimension generally greater than 3 mm in diameter.

4. The buoyant cushion of claim 3 wherein said predetermined size openings of said mesh fabric have a dimension generally smaller than 3 mm in any direction, to prevent passage of said buoyant beads through said predetermined size openings of said mesh fabric.

5. The buoyant cushion of claim 1 further including a rim of said fabric materials about said chamber.

6. The buoyant cushion of claim 5 further comprising at least one grommet disposed through said rim through which a tether can be attached for securing said cushion to a structural support adjacent the water.

7. The buoyant cushion of claim 5 further comprising a plurality of spaced grommets disposed through said rim through which one or more tethers can be attached for securing said cushion to one or more structurally supports adjacent the water.

8. The buoyant cushion of claim 1 wherein said plurality of buoyant beads are of virgin polystyrene material, said buoyant beads having a dimension generally greater than 3 m in diameter, said predetermined size openings of said mesh fabric having a dimension generally smaller than 3 mm in any direction to prevent passage of said buoyant beads through said predetermined size openings of said mesh fabric, said buoyant cushion further including a rim of said fabric materials about said chamber.

9. The buoyant cushion of claim 8 further comprising at least one grommet disposed through said rim through which a tether can be attached for securing said cushion to a structural support adjacent the water.

10. The buoyant cushion of claim 1 wherein said flexible fabric material defines an entire said upper surface of said cushion, and a portion of said lower surface, and said flexible mesh fabric material and said flexible fabric material define said lower surface of said cushion.

11. The buoyant cushion of claim 1 wherein said plurality of buoyant beads are of virgin polystyrene material, said buoyant beads having a dimension generally greater than 3 mm in diameter, said predetermined size openings of said mesh fabric having a dimension generally smaller than 3 mm in any direction, to prevent passage of said buoyant beads through said predetermined size openings of said mesh fabric, said flexible fabric material and said flexible mesh fabric material defining said lower surface of said casing of said cushion.

12. A buoyant cushion comprising a casing defining a chamber therewithin, said casing being formed by an exterior covering of a substantially weather-resistant flexible fabric material forming an upper surface of said cushion and at least a portion of a lower surface of said cushion, and a materially different substantially weather-resistant flexible mesh fabric material sewn together to form said casing, said mesh fabric material being more rigid than said flexible fabric material and forming at least another portion of said lower surface and having predetermined size openings therethrough, a plurality of buoyant expanded virgin polystyrene beads having a size greater than said predetermined size openings generally smaller than 3 mm in any direction and disposed within said chamber and partially filling said chamber between 70% to 75% of capacity of said chamber, said buoyant beads having a size generally greater than 3mm in any direction, providing said cushion with sufficient buoyancy to support a user on said upper surface of said cushion in a body of water to maintain such user at least partially above the water, said mesh fabric material permitting water to flow through said predetermined size openings into said chamber during use of said cushion in water to enhance comfort of such user on said upper surface and the stability of said cushion in water, and to permit drainage therefrom when said cushion is removed from the water.

13. The buoyant cushion of claim 12 further including a rim of said fabric materials about said chamber.

14. The buoyant cushion of claim 13 further comprising at least one grommet disposed through said rim through which a tether can be attached for securing said cushion to a structural support adjacent the water.

15. The buoyant cushion of claim 13 further comprising a plurality of spaced grommets disposed through said rim through which one or more tethers can be attached for securing said cushion to one or more structural supports adjacent the water.

16. The buoyant cushion of claim 12 wherein said flexible fabric material defines an entire said upper surface of said cushion and a portion of said lower surface, and said flexible mesh fabric material and said flexible fabric material define said lower surface of said cushion.

* * * * *